US005181408A

United States Patent [19]

Yeh et al.

[11] Patent Number: 5,181,408

[45] Date of Patent: Jan. 26, 1993

[54] METHOD OF MEASURING AND COMPENSATING ROLL ECCENTRICITY OF A ROLLING MILL

[75] Inventors: Tse-Huei Yeh; Song-Jau Tsai; Chang-Tsun Lin, all of Kaohsiung; Long-Gee Liao; Tsai-Sheng Huang, both of Kaohsiung Hsien, all of Taiwan

[73] Assignee: China Steel Corp., Ltd., Taiwan

[21] Appl. No.: 672,240

[22] Filed: Mar. 20, 1991

[51] Int. Cl.[5] ..... B21B 37/00; G01L 5/00; G06G 7/48; G01D 18/00

[52] U.S. Cl. ..... 72/11; 72/21; 73/862.55; 364/472; 364/571.02

[58] Field of Search ..... 72/8–16, 72/20, 21, 6, 7, 35; 73/1 B, 1 E, 862.55; 364/176, 472, 474.12, 571.02, 571.04, 571.07

[56] References Cited

U.S. PATENT DOCUMENTS

| | | | |
|---|---|---|---|
| 3,881,335 | 5/1975 | Cook | 72/11 |
| 3,882,705 | 5/1975 | Fox | 72/11 |
| 4,126,027 | 11/1978 | Smith, Jr. et al. | 72/21 |
| 4,648,257 | 3/1987 | Oliver et al. | 72/8 |

FOREIGN PATENT DOCUMENTS

| | | | |
|---|---|---|---|
| 1239212 | 7/1971 | United Kingdom | 72/7 |

*Primary Examiner*—Lowell A. Larson
*Assistant Examiner*—Thomas C. Schoeffler
*Attorney, Agent, or Firm*—Sughrue, Mion, Zinn, Macpeak & Seas

[57] ABSTRACT

A method of correcting the thickness variations of a rolling plate by controlling at least one of the top or bottom backup rolls of a rolling mill. The method further comprises an off-line eccentricity identification method, and an on-line eccentricity compensation method. The off-line eccentricity identification method is utilized for establishing an eccentricity vector which stores the eccentricity values of the top and the bottom backup rolls. The on-line eccentricity compensation method is utilized for generating eccentricity compensation signals using the eccentricity vector established by the foregoing off-line eccentricity identification method, and for transferring the eccentricity compensation signals to an automatic gauge control (AGC) system for compensating the backup roll eccentricities and thus correcting the thickness variations of a rolling plate.

2 Claims, 10 Drawing Sheets

METHOD OF MEASURING AND COMPENSATING ROLL ECCENTRICITY OF A ROLLING MILL

BACKGROUND OF THE INVENTION

1. Field of the Invention

The present invention relates to a method of measuring and compensating the eccentricities of the backup rolls of a rolling mill for correcting the thickness variations of a rolling plate caused by the eccentricities of the backup rolls.

2. Description of Prior Arts

A rolled plate with uniform thickness and flatness from a rolling mill is a goal constantly pursued by many steel plate manufacturers. Among the various factors which affect the thickness and flatness of the rolling plate, eccentricity of the backup roll is most decisive. Many systems and methods have been proposed and devised therefore for compensating the roll eccentricities to minimize the thickness variations of the rolling plates. And many of them have been disclosed in the U.S. patents, such as U.S. Pat. No. 4,222,254 to King et al, Pat. No. 4,648,257 to Oliver et al, or Pat. No. 4,299,104 to Hayama et al . . . etc. Typically, the prior arts including the foregoing disclosures can be categorized into the three following methods:

(a) Fourier series method: This method takes the measurement of the cyclic thickness change of a rolling plate as a time-domain waveform and utilizes the Fourier transform technique to find the corresponding amplitudes and phases which are used as the compensation signals to be sent to an automatic gauge control system to correct the thickness variations of the rolling plate caused by the roll eccentricity.

(b) Total eccentricity lookup table method: This method firstly builds an eccentricity table off-line by rotating the backup rolls a full cycle and records the eccentricity values of a number of points on the peripheries of the backup rolls.

(c) Bandpass filter method: This is an on-line method which regards the angular velocity of the backup rolls as the frequency component, and designs a bandpass filter, with the center frequency of the pass band being the angular velocity, to extract the rolling force signals and convert the signals into the controlling signals to control the rolling force.

Among these methods, the Fourier transform method has the drawback of a less precise controlling signal since that only the fundamental frequency, ignoring the many other existing harmonics, is extracted to control the thickness variations of the rolling plate. Moreover, the system is also expensive to implement and difficult to maintain. The lookup table method, on the other hand, offer a more precise rolling plate, but it still has the drawback that the building of the enormous lookup table is quite time-consuming and tedious. The on-line methods are suited only for the products which require continuous rollings, such as cold and hot rolling.

SUMMARY OF THE INVENTION

It is, therefore, an object of the present invention to provide a method of measuring and compensating the eccentricities of the backup rolls of a rolling mill to reduce the thickness variations of a rolling plate caused by the eccentricities of the backup rolls.

The objects are achieved in accordance with the present invention by providing a method of measuring and compensating the roll eccentricities of the rolling mill, the method further comprises an off-line eccentricity identification method and an on-line eccentricity compensation method.

The off-line eccentricity identification method is performed without rolling plate. It is utilized to establish an eccentricity vector which stores the eccentricity values of the top and the bottom backup rolls.

The on-line compensation method is performed when a rolling plate is being rolled through the work rolls. The method firstly detects the angular position of the backup rolls, then calculates a compensation value, and finally converts the compensation value into an eccentricity compensation signal which is transferred to an automatic gauge control (AGC) system for controlling at least one of the backup rolls to compensate the roll eccentricity and thus reduce the thickness variations of the rolling plates.

An apparatus is also employed to the rolling mills for performing the off-line eccentricity identification method and the on-line compensation method described above. The apparatus includes position encoders, a load cell, computing means, and an automatic gauge control (AGC) system. The apparatus is well known and utilized in some of the prior disclosures.

The above objects and features of the method according to the present invention will become more apparent to those who are skilled in the art by a reading of the following detailed description of a preferred embodiment with reference to the accompanying drawings.

DETAILED DESCRIPTION OF THE PREFERRED EMBODIMENT

Figure 1:
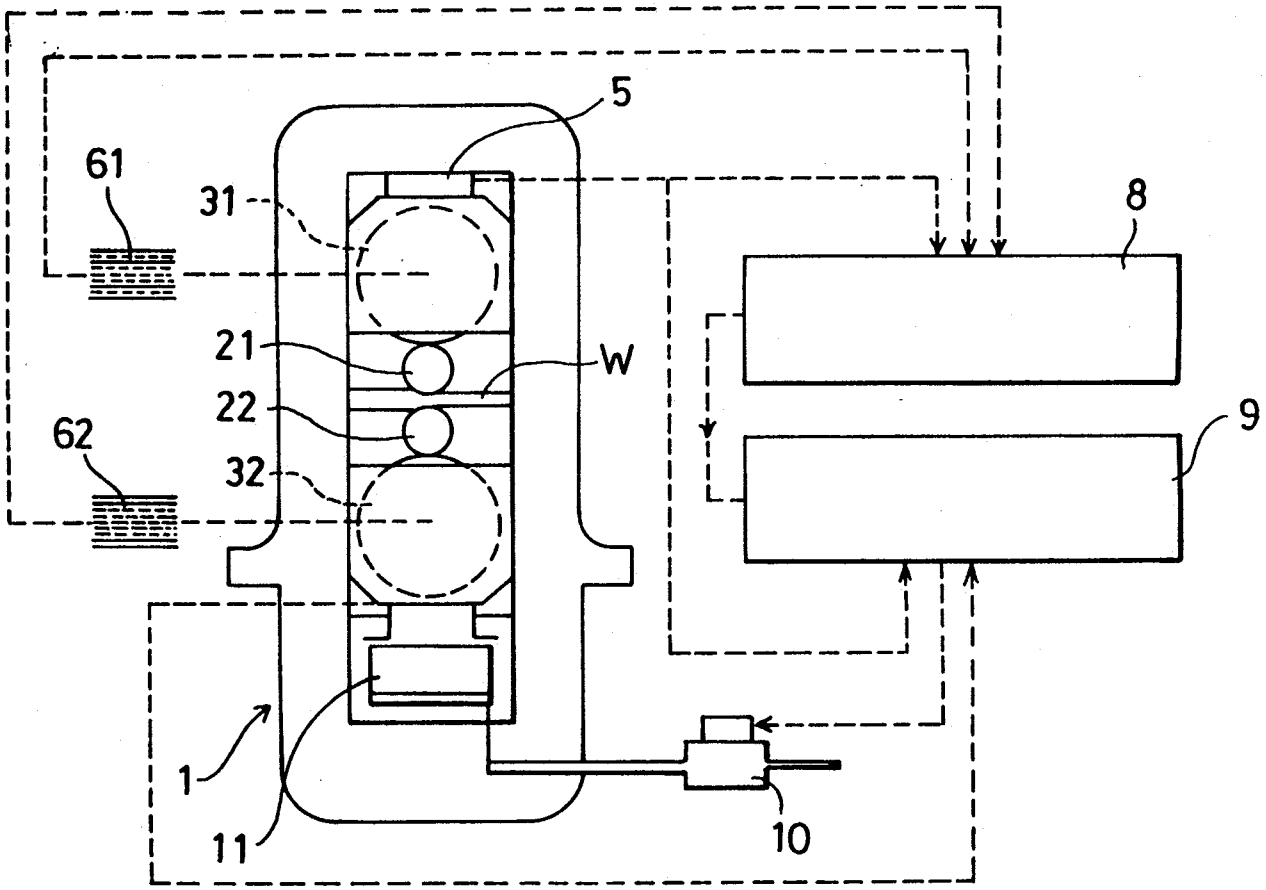
FIG. 1 is a schematic representation of a rolling mill with an apparatus employed for performing the method according to the present invention.

Referring now to FIG. 1, there is shown a schematic representation of a rolling mill with an apparatus employed for performing the method according to the present invention. As illustrated, a reference numeral 1 designate a rolling mill, reference numerals 21 and 22 designate respectively a top work roll and a bottom work roll, reference numerals 31 and 32 designate respectively a top backup roll and a bottom backup roll, and a letter W designates a workpiece which is being passed through the gap between the work rolls 21 and 22.

The apparatus employed for performing the method according to the present invention, also shown in FIG. 1, includes a load cell 5 for measuring an output signal which is proportional to the force occasioned by passing the workpiece W between the work rolls 21 and 22; two position encoders 61 and 62, each is associated with one of the backup rolls 31 and 32, for detecting an output signal corresponding to the angular positions of the backup rolls 31, 32 and converting the output signal into numerical data; a data storage and computing means 8 for receiving the data from the load cell 5 and the position encoders 61 and 62, and processing the data; a servo valve controlling means 9; a servo valve 10; and a hydraulic cylinder 11. The apparatus has been employed in an automatic gauge control (AGC) system by some prior disclosures for achieving the same purpose as of the present invention, so that no further details will be described.

Figure 2:
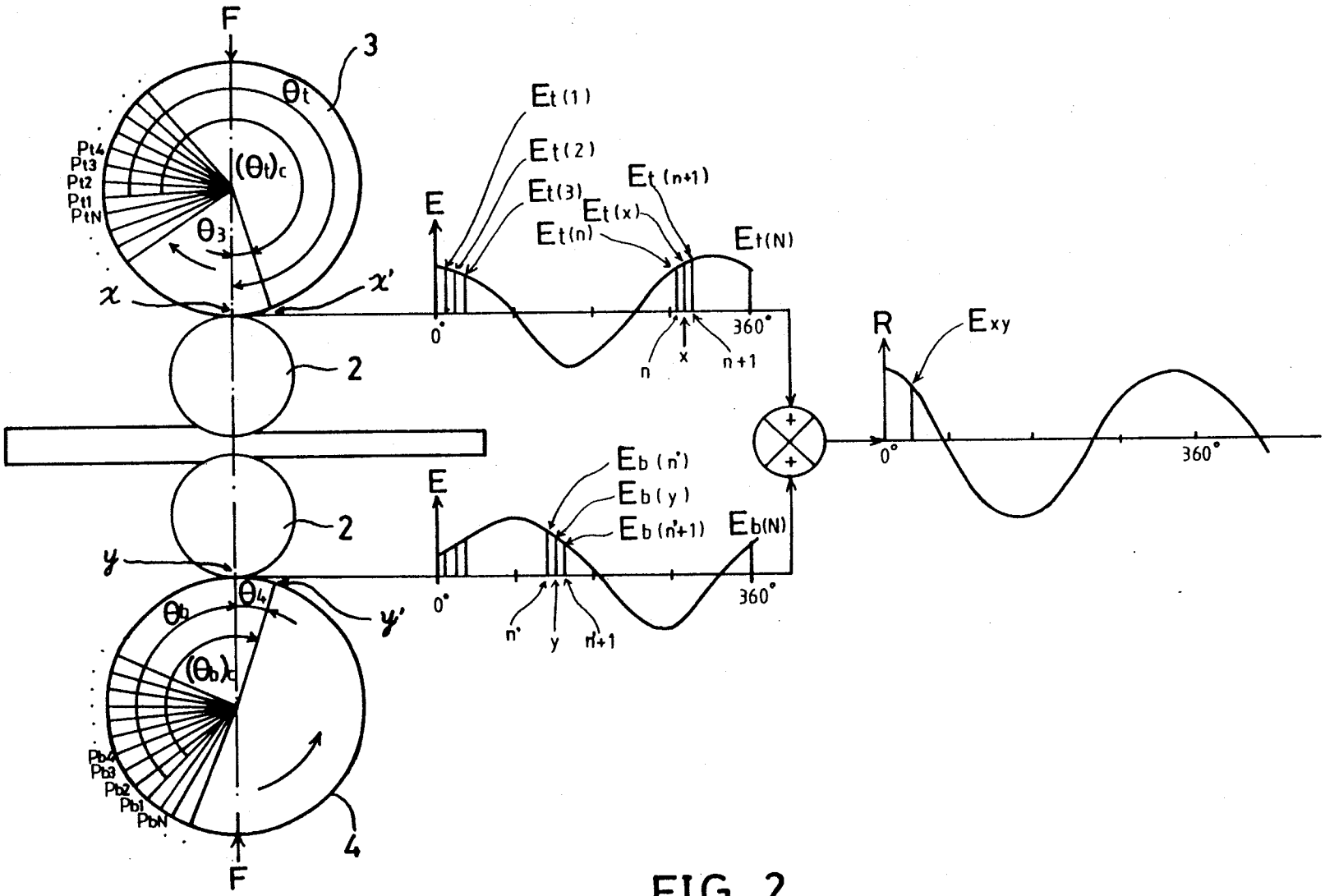
FIG. 2 is an illustration including a schematic representation showing the on-line process of the backup rolls and the work rolls rolling a workpiece, and graphical representations showing the backup roll eccentricities.

Referring now to FIG. 2, the definition of the roll eccentricity is fully demonstrated by the illustration, wherein are a schematic representation showing the on-line process of the backup rolls 31, 32 and the work rolls 21, 22 rolling a workpiece W, and graphical representations showing the backup roll eccentricities. The eccentricity values of the points on the peripheries of the backup rolls 31, 32 are represented in the two accompanying graphs. The varying of the roll eccentricity values shown in the graphs is a result of the shape irregularity of the backup rolls 31, 32. For clarifying purpose, some denominations are first made to the backup rolls. As shown in the figure, the circumference of the top backup roll 31 is divided equally by a large integer number N, and the N dividing points are designated $Pt_1$, $Pt_2$, $Pt_3$ . . . $Pt_N$. If the distance between a certain point $Pt_i$ and the rotating center of the backup roll is designated $OPt_i$, and let $$OPt_{mean}=(Pt_1+Pt_2+Pt_3+\ldots+Pt_N)/N,$$

then the eccentricity values ET(1), ET(2), . . . and ET(N) of the N points are defined as $$Et(i)=OPt_i-OPt_{mean},\ i=1, 2, \ldots N.$$

Figure 3:
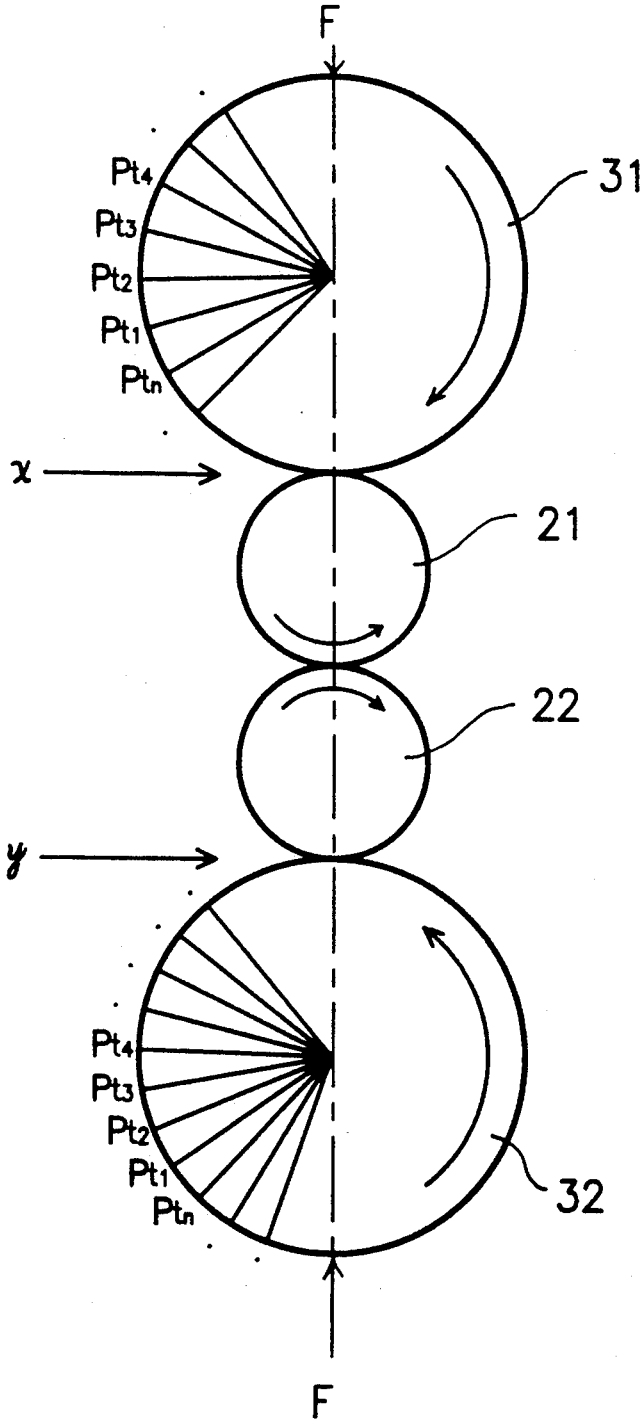
FIG. 3 is a schematic representation showing the top and bottom backup rolls in contact with each other in the off-line process.

The same denomination and definition are applied to the bottom backup roll 32, and the N dividing points are designated $Pb_1$, $Pb_2$. . . $Pb_N$, the eccentricity values of the N points are designated Eb(1), Eb(2) . . . Eb(N). Also shown in FIG. 3, x is a point on the circumference of the top backup roll 31 thereat the top backup roll 31 is in contact with the top work roll 21, while y is a point on the circumference of the bottom backup roll 32 thereat the bottom backup roll 32 is in contact with the bottom work roll 22. The eccentricity values at x and y are denoted by Et(x) and Eb(y) respectively.

Figure 5:
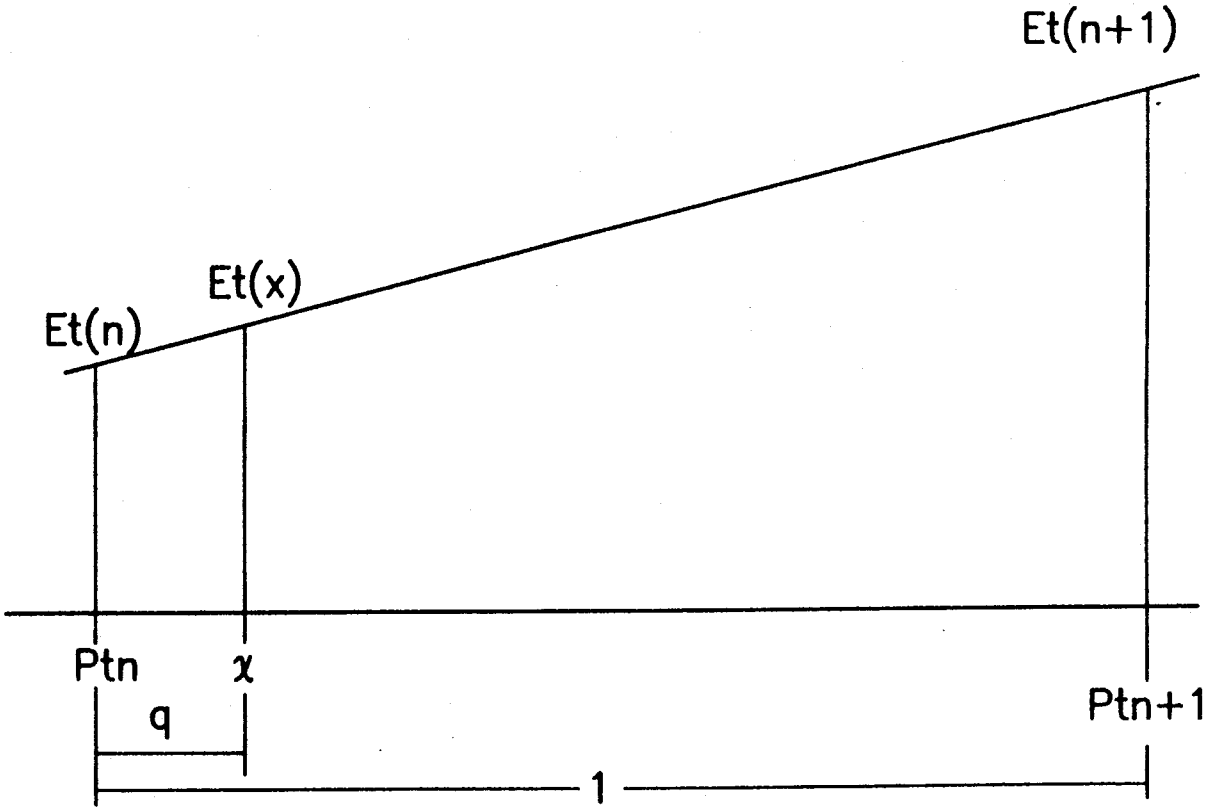
FIG. 5 is a graphical representation showing the calculation of an eccentricity value of an arbitrary point x on the roll periphery by interpolation method.

Referring now to FIG. 5, x is assumed to be between $Pt_n$ and $Pt_{n+1}$. If the integer number N is large enough, we can assume the curve of the eccentricity values between $Pt_n$ and $Pt_{n+1}$ being a straight line segment. Assume Et(n) and Et(n+1) are known values, then the eccentricity value Et(x) of the point x can be approximated by an interpolation method as:

$$Et(x)=(1-q)*Et(n)+q*Et(n+1),$$

wherein q is the ratio of the distance between x and $Pt_n$ to the distance between $Pt_n$ and $Pt_{n+1}$. The same manner is applied to the bottom backup roll 32 and Eb(y) can be derived as:

$$Eb(y)=(1-q')*Eb(n')+q'*Eb(n'+1),$$

wherein q' is the ratio of the distance between y and $Pb_n$ to the distance between $Pb_n$ and $Pb_{n+1}$.

Figure 6:
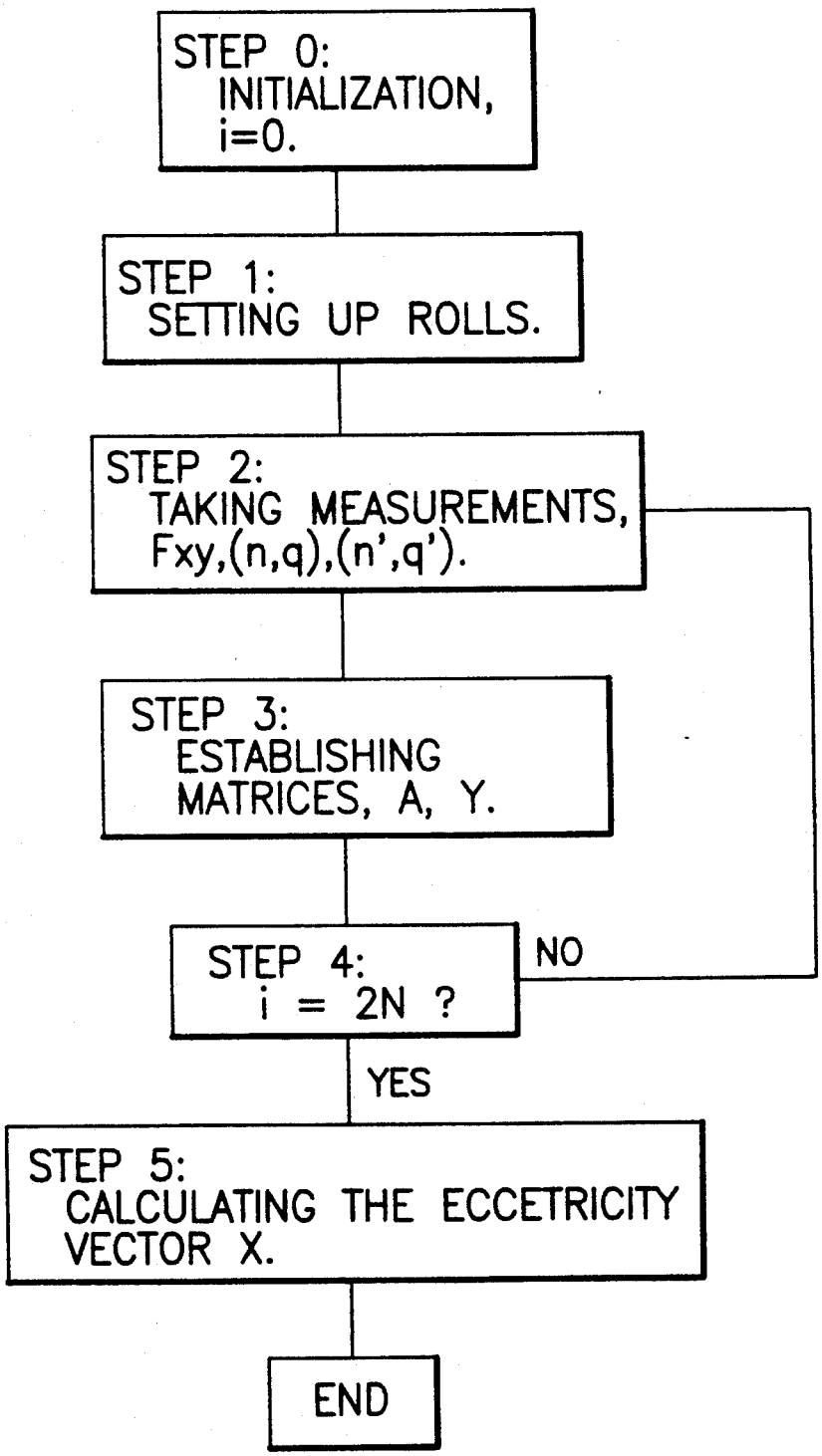
FIG. 6 is a flow diagram showing the steps of an off-line eccentricity identification method.
Figure 7:
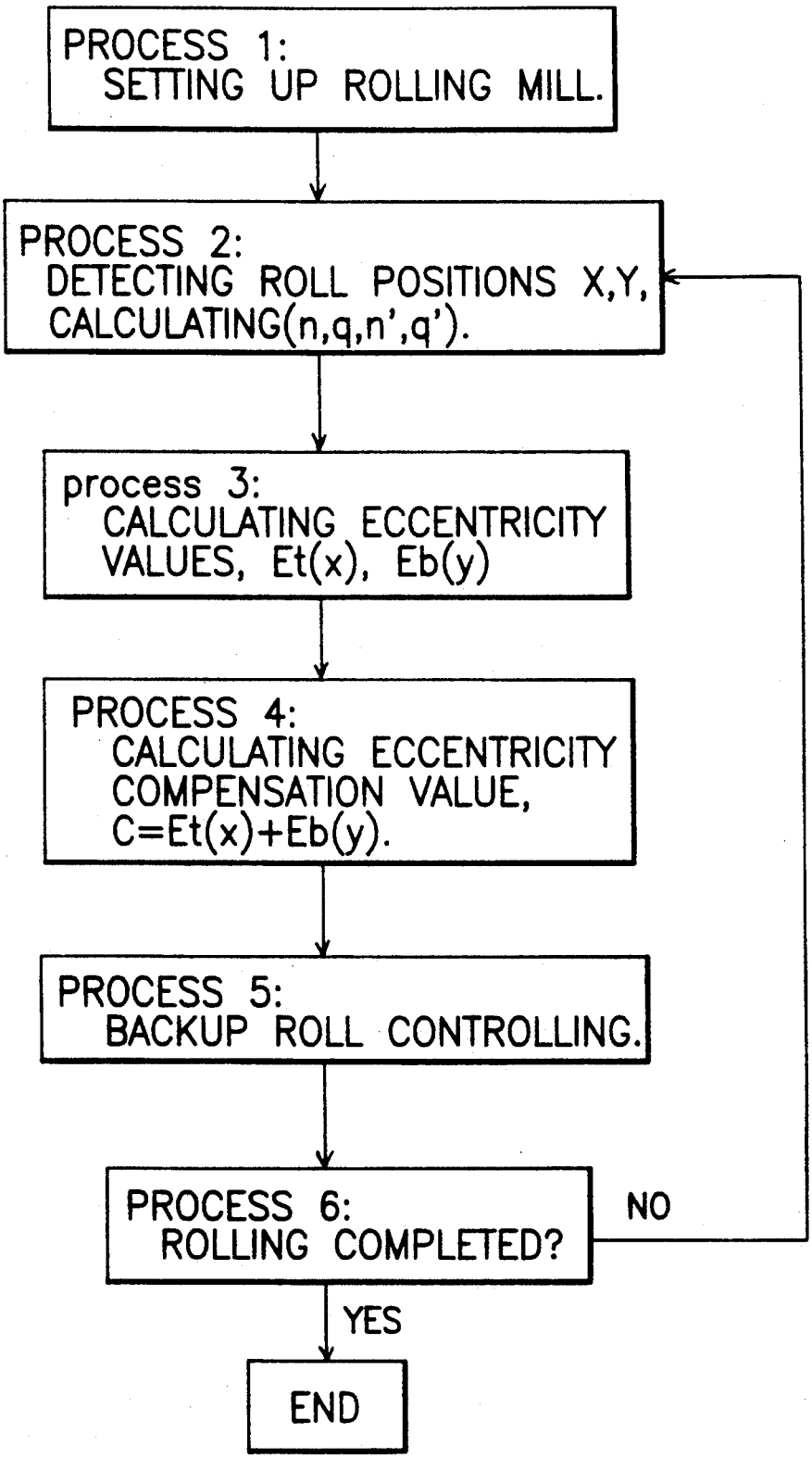
FIG. 7 is a flow diagram showing the steps of an on-line eccentricity compensation method.

The method according to the present invention, which is performed by the apparatus described above, comprises an off-line eccentricity identification method and an on-line eccentricity compensation method. The off-line method is performed firstly without the load (i.e. with the workpiece W being removed and the two work rolls 21,22 being pressed to come in contact with each other) to determine the eccentricity values around the peripheries of the top and bottom backup rolls 31,32. The eccentricity values are stored in an eccentricity vector and are retrieved afterward by the on-line method to calculate the eccentricity compensation values. These two methods will be described respectively hereinafter in details, and reference may be made to FIGS. 6 and 7 which are the flow diagrams of the two methods.

THE OFF-LINE ECCENTRICITY IDENTIFICATION METHOD

The eccentricity identification method is performed off-line (i.e. without the workpiece W being rolled through the work rolls 21,22). An algorithm is developed and included in this method for computing an eccentricity vector X whose entries are the eccentricity values of the top and the bottom backup rolls 31,32. The diameter of the top backup roll 31 is assumed to be slightly different from that of the bottom backup roll 32. The algorithm is implemented by the data storage and computing means 8.

The development of the algorithm is based on the following four relations:

$$E_{xy}=(1/M)*\Delta F_{xy} \quad (1),$$

$$E_{xy}=Et(x)+Eb(y) \quad (2),$$

$$Et(x)=(1-q)*Et(n)+q*Et(n+1) \quad (3),$$

$$Eb(y)=(1-q')*Eb(n')+q'*Eb(n'+1) \quad (4),$$

wherein x = a point between $Pt_n$ and $Pt_{n+1}$, and thereat the top backup roll 31 is in contact with the top work roll 21;

y = a point between $Pb_{n'}$ and $Pb_{n'+1}$, and thereat the bottom backup roll 32 is in contact with the bottom work roll 22;

$E_{xy}$ = resultant eccentricity value;

M = mill modulus;

$\Delta F_{xy}$ = variation value of the rolling force;

Et(x) = the eccentricity value of the point x;

Eb(y) = the eccentricity value of the point y.

Equations (1), (2), (3), (4) can be combined into one equation as:

$$(1-q)*Et(n)+q*Et(n+1)+(1-q')*Eb(n')+q'*Eb(n'+1)=(1/M)*\Delta F_{xy} \quad (5).$$

Writing the left hand side of the equation (5) into a product of two vectors, we have $$A_i X=(1/M)*\Delta Fxy,$$

wherein $A_i$ is a 1 by 2N row vector, X is a 2N by 1 column vector, and column:

$$A_i=\begin{array}{cccccccccccccc} 1 & 2 & 3 \ldots & n & n+1 & n+2 \ldots N & N+1 & N+2 \ldots N+n' & N+n'+1 \ldots 2N \\ [0 & 0 & 0 \ldots 1-q & q & 0 & \ldots 0 & 0 & 0 \ldots 1-q' & q' \ldots 0], \end{array}$$

and $$X=\begin{bmatrix} Et(1) \\ \cdot \\ \cdot \\ Et(n) \\ Et(n+1) \\ \cdot \\ \cdot \\ Et(N) \\ Eb(1) \\ \cdot \\ \cdot \\ Eb(n') \\ Eb(n'+1) \\ \cdot \\ \cdot \\ Eb(N) \end{bmatrix}.$$

The values of the variables q and q' in Equation (5) are detected and determined by the position encoders 61 and 62, Fxy is detected and determined by the load cell 5, and M is a known constant. Therefore the 2N unknowns Et(1), Et(2), . . . Et(N), Eb(1), Eb(2), . . . and Eb(N) can be calculated by establishing 2N simultaneous equations using Equation (5) with the position parameters (n,q,n',q') and the corresponding rolling force variation $\Delta F_{xy}$ taken at 2N different angular positions. The 2N simultaneous equations may be written in a matrix form as:

$$\begin{bmatrix} A_1 \\ A_2 \\ \cdot \\ \cdot \\ A_N \\ A_{N+1} \\ A_{N+2} \\ \cdot \\ \cdot \\ A_{2N} \end{bmatrix} * \begin{bmatrix} Et(1) \\ Et(2) \\ \cdot \\ \cdot \\ Et(N) \\ Eb(1) \\ Eb(2) \\ \cdot \\ \cdot \\ Eb(N) \end{bmatrix} = (1/M) * \begin{bmatrix} \Delta Fxy(1) \\ \Delta Fxy(2) \\ \cdot \\ \cdot \\ \cdot \\ \cdot \\ \cdot \\ \cdot \\ \cdot \\ \Delta Fxy(2N) \end{bmatrix},$$

or AX = Y, wherein $A_i$ is the 1 by 2N row vector corresponding to the (i)th angular position measurement; Fxy(i) is the corresponding (i)th rolling force variation measurement; A is called a position matrix and is a 2N by 2N matrix; and Y is called a measurement vector and is a 2N by 1 column vector.

If the rank of matrix A is exactly 2N, then the equation AX = Y will have a unique solution for X. However, this may not be always the case once in a while. To avoid this impasse from happening, the following method is utilized.

Initially, the top backup roll 31 and the bottom backup roll 32 are jammed together without slip. And this constraint will make the maximum rank of matrix A to be 2N − 1. To solve the simultaneous equations, substitute an arbitrary (k)th row in matrix A with $A_k$, where column:

$$A_k=\begin{array}{cccccccc} 1 & 2 & 3 \ldots & k & \ldots 2N \\ [0 & 0 & 0 \ldots 0 & 1 & 0 \ldots & 0], \end{array}$$

to obtain a new matrix A'; and assign $F_{xy}(k)=0$ as a reference solution and replaced the (k)th entry of vector Y with it to obtain a new matrix Y'. In this manner, we can then obtain a new matrix equation A'X = Y', and X can thus be solved as $X=(A')^{-1}\ Y'$ by numerical method.

The off-line eccentricity identification method, in accordance with the foregoing notions, comprises the following steps of:

Step 0: Selecting an integer number N;

dividing the circumferences of the top backup roll 31 and the bottom backup roll 32 into N equal arcs;

designating the N dividing points of the top backup roll 31 $Pt_1, Pt_2, \ldots Pt_N$, and the eccentricity values of the N points Et(1), Et(2), . . . Et(N);

designating the N dividing points of the bottom backup roll 32 $Pb_1, Pb_2, \ldots Pb_N$, and the the eccentricity values of the N points Eb(1), Eb(2), . . . Eb(N); and establishing a 2N by 1 eccentricity vector X, a 2N by 2N position matrix A, a 2N by 1 measurement vector Y, wherein $$X=[Et(1), Et(2), \ldots Et(N), Eb(1), Eb(2), \ldots Eb(N)]^T;$$

and setting i=0;

Step 1:

removing the workpiece W (rolling plate);

jamming the two backup rolls 31, 32 together to make the two work rolls 21, 22 come in contact with each other without slip; and rotating the two backup rolls 31, 32 in a steady angular speed;

Step 2:

measuring at the same time the following parameters:

(1) the value of the variation of the rolling force, dividing it by the mill modulus M, and storing the value in a variable Exy, (2) a position x of the top backup roll 31, thereat the top backup roll 31 is in contact with the top work roll 21; and finding the parameters (n,q), whereof $Pt_n$ and $Pt_{n+1}$ are the two neighboring points encompassing x, and q is the ratio of the distance between x and $Pt_n$ to the distance between $Pt_n$ and $Pt_{n+1}$; and (3) a position y of the bottom backup roll 32 thereat the bottom backup roll 32 is in contact with the bottom work roll 22;

finding the parameters (n',q'), whereof $Pb_{n'}$ and $Pb_{n'+1}$ are the two neighboring points encompassing y, and q' is the ratio of the distance between y and $Pb_{n'}$ to the distance between $Pb_n$ and $Pb_{n'+1}$;

Step 3:

setting i=i+1;

storing the position parameters (n,q,n',q') in the (i)th row of the position matrix A according to the following manner:

column:

$$\begin{array}{lllllllll} 1\ 2\ 3 \ldots & n & n+1 & n+2 \ldots N & N+1 & N+2 \ldots N+n' & N+n'+1 \ldots 2N \\ [0\ 0\ 0 \ldots 1-q & q & 0 \ldots 0 & 0 & 0 \ldots 1-q' & q' & \ldots\ 0]; \end{array}$$

and storing $E_{xy}$ in the (i)th entry of the measurement vector Y;

Step 4:

repeating Step 2 to Step 3 until i=2N;

Step 5:

replacing an arbitrary (k)th row in matrix $A$ with $A_k$, where column:

$$\begin{array}{l} \quad 1\ 2\ 3 \ldots\ k\ \ldots 2N \\ A_k=[0\ 0\ 0 \ldots 0\ 1\ 0 \ldots\ 0], \end{array}$$

to obtain a new matrix A';

replacing the (k)th entry of vector Y with a reference solution $F_{xy}(k)=0$ to obtain a new vector Y';

calculating the matrix equation $(A')^{-1}Y'$ and storing the result in the eccentricity vector X; and replacing the (k)th entry of vector X with a value linearly interpolating the (k−1)th and the (k+1)th entry of vector X. (i.e. X(k)=[X(k−1)+X(k+1)]/2);

The integer N affects the performance of the system in such a way that a larger N increases both the precision of the interpolated eccentricity values and the computing complexity of the algorithm. The former is desired but not the latter one. A selection of N=36 is utilized in the present embodiment, which provides a good precision for the eccentricity values and not too much complexity for the manipulating of the matrices by the data storage and computing means 8.

In Step 1 of the foregoing off-line eccentricity identification method, the work rolls 21,22 are pressed to exert a rolling force within 1500 to 2000 tons, and the angular velocity thereof is about 40 rpm. The variation of this rolling force, which is due to the backup roll eccentricity, is measured in Step 2.

Figure 4:
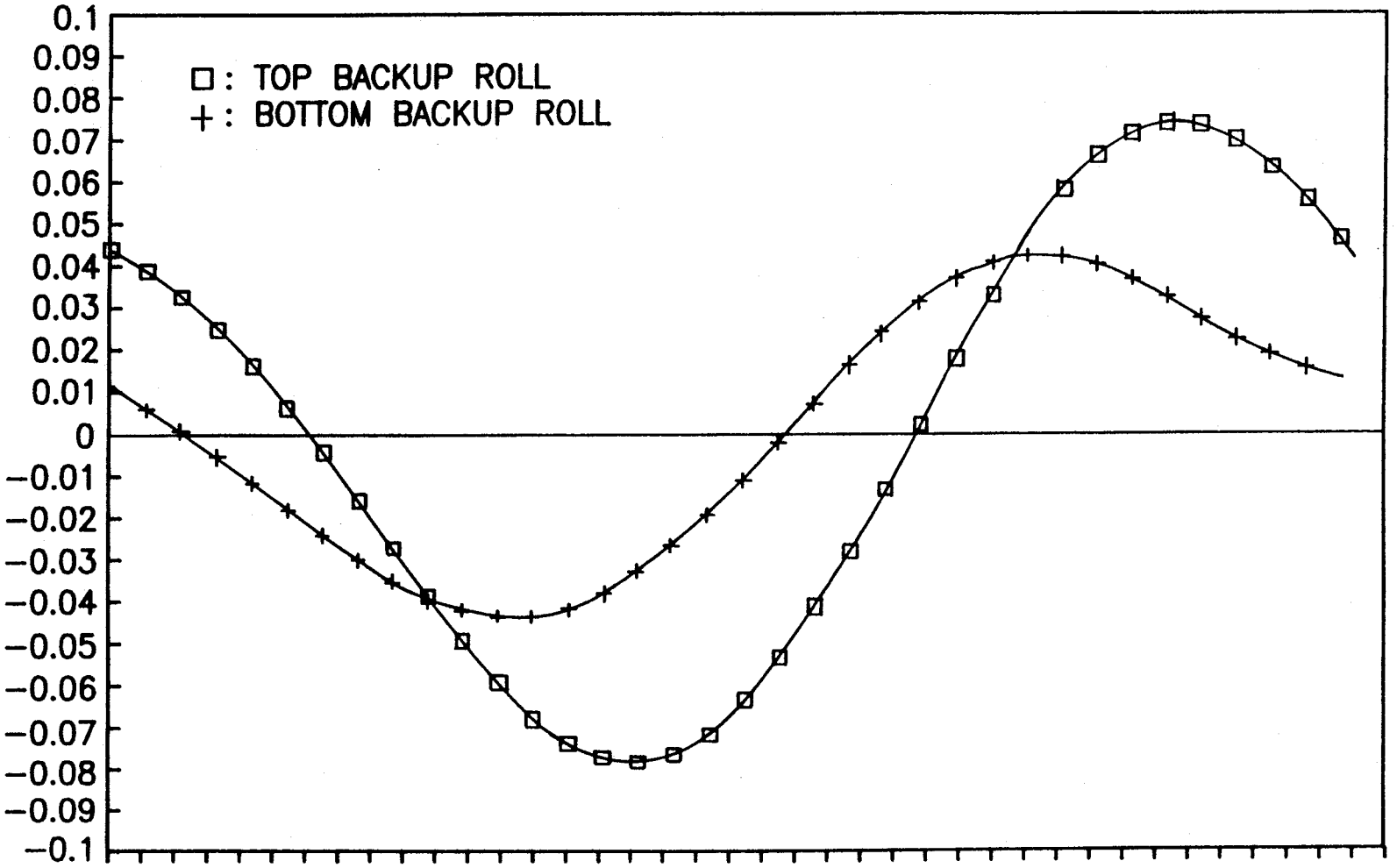
FIG. 4 is a graphical representation of the eccentricity values of a number of points on the peripheries of the top and the bottom backup rolls.

The result of Step 6, i.e. the eccentricity vector, is stored in a permanent storage means of the data storage and computing means 8 (such as in a hard disk of a digital computer system). A graphical representation of the empirical eccentricity values of both the top and the bottom backup rolls 31,32 is illustrated in FIG. 4. These data will afterwards be retrieved for calculating the eccentricity compensation values by the on-line eccentricity compensation method described hereinafter.

THE ON-LINE ECCENTRICITY COMPENSATION METHOD

The eccentricity compensation method is performed on-line (i.e. with the workpiece W being rolled through the work rolls 2), which comprises the following processes of:

Process 1: directing the workpiece W (a rolling plate) to be rolled through the rolling mill 1;

Process 2:

detecting the positions x and y of the points of the backup rolls 31, 32, thereat the backup rolls 31, 32 are in contact with the work rolls 21, 22; and finding the position parameters (n, q, n', q');

Process 3: calculating the eccentricity values Et(x), Et(y) of the positions x and y by retrieving the corresponding data from the eccentricity vector X and in accordance with the following relations:

$$Et(x)=(1-q)*Et(n)+q*Et(n+1)$$

and $$Eb(y)=(1-q')*Eb(n')+q'*Eb(n'+1);$$

Process 4: determining the eccentricity compensation value C, where $C=Et(x)+Et(y)$;

Process 5: converting the eccentricity compensation value C into controlling signal for controlling at least one of the backup rolls to compensate the eccentricities thereof; and Process 6:

if the rolling is not completed then going back to Process 2 and performing therefrom; else ending the processes.

Process 2 occurs at an interval of 10 ms, that is to say, the compensating occurs discretely at a rate of 100 time/sec. The discrete nature of the controlling is due to a time lapse t, which is the time between the occurrence of the position detecting and the occurrence of the adjusting of the backup rolls by the AGC system, and is caused by the computing time of the computing means 8 and system response time of the AGC system. Therefore, the controlling is intermittently rather than continuously.

For the reason of the lapse time t, when the controlling signal is sent to the hydraulic cylinder 11, the backup rolls will have already advanced a certain distance forwards. Therefore, the positions detected by the position encoders 61, 62 in Process 2 have to be shifted forward before sending into the data storage and computing means 8. The correction of the detected position data is in accordance with the following equations:

$$(x)_c=xw*K_t*t$$

$$(y)_c=yw*K_b*t$$

wherein x, y: are the points of the top and the bottom backup rolls thereat the backup rolls 31 and 32 are in contact with the work rolls 21 and 22, and which are detected by the position encoder 61, 62;

(x)c, (y)c: are the corrected positions of x and y, thereat the eccentricity compensation will actually take place;

t: the system response delay time;

Kt, Kb: are the ratios of the angular velocities of the backup rolls 31, 32 to the angular velocity of the driving motor (not shown); and w: the angular velocity of the driving motor.

Process 3' utilizes the same interpolated equations:

$$Et(x)=(1-q)*Et(n)+q*Et(n+1),$$

and $$Eb(y)=(1-q')*Eb(n')+q'*Eb(n'+1),$$

for Et(x) and Eb(y) as in the off-line method, except that Et and Eb at this time are known values retrieved from the eccentricity vector X. The parameters (n,n',q,q') are the measurement parameters determined by the position encoders 61,62 as in the off-line method.

In Process 5, the servo valve controlling means 9 is utilized for converting the eccentricity compensating value C into the controlling signal, and transferring the controlling signal to the servo valve 10. The servo valve 10, in turn, drive the hydraulic cylinder 11 to move vertically, upwards or downwards. The vertical motion of the hydraulic cylinder 11 drives at least one of the backup rolls (the bottom backup roll 32 only in this preferred embodiment) to move, thereby, upwards of downwards. The displacement of the vertical movement of the backup roll, which is in accordance with the eccentricity compensation value C, thus compensates the effects caused by the backup roll eccentricities.

Figure 8:
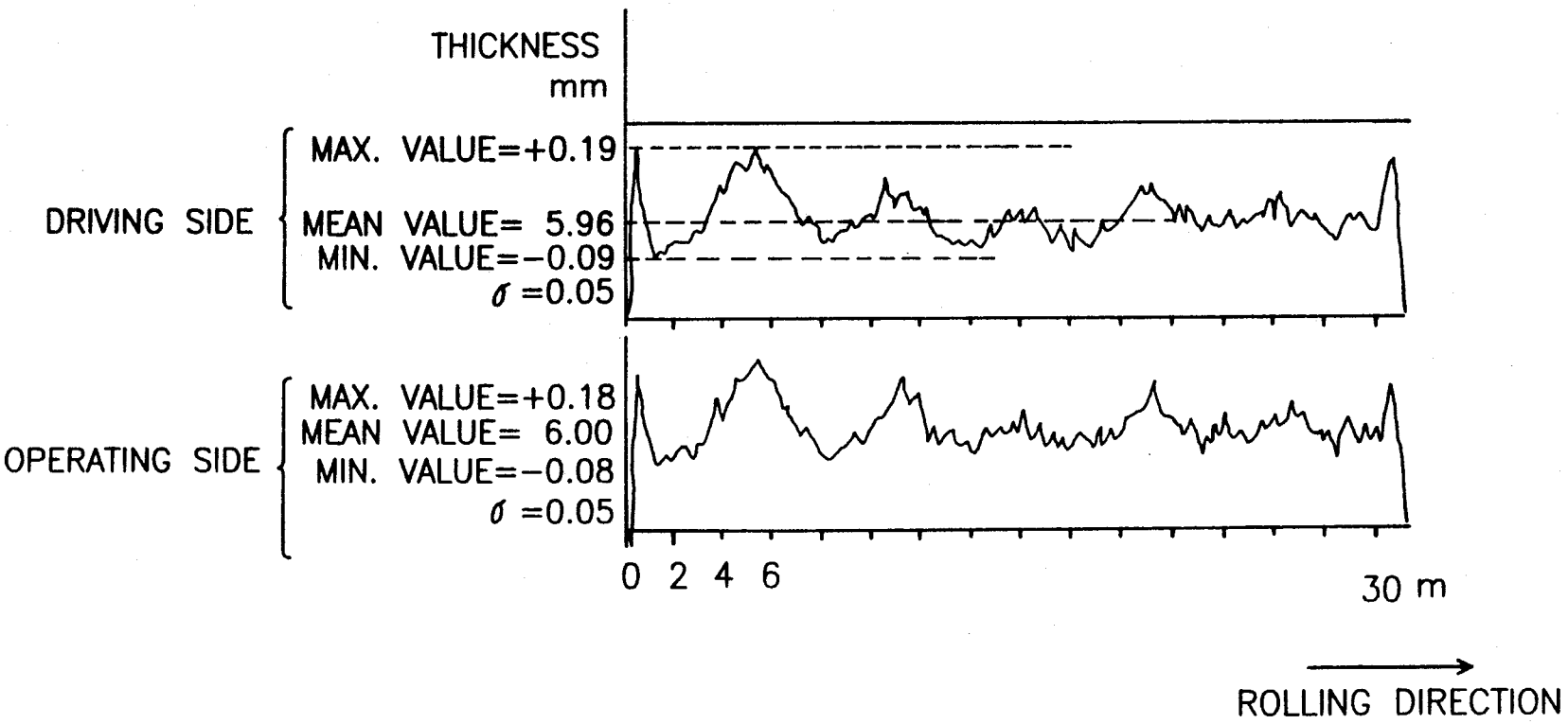
FIG. 8 shows two graphical representations of the thickness variations of the two sides of a rolling plate without the roll eccentricities being compensated.
Figure 9:
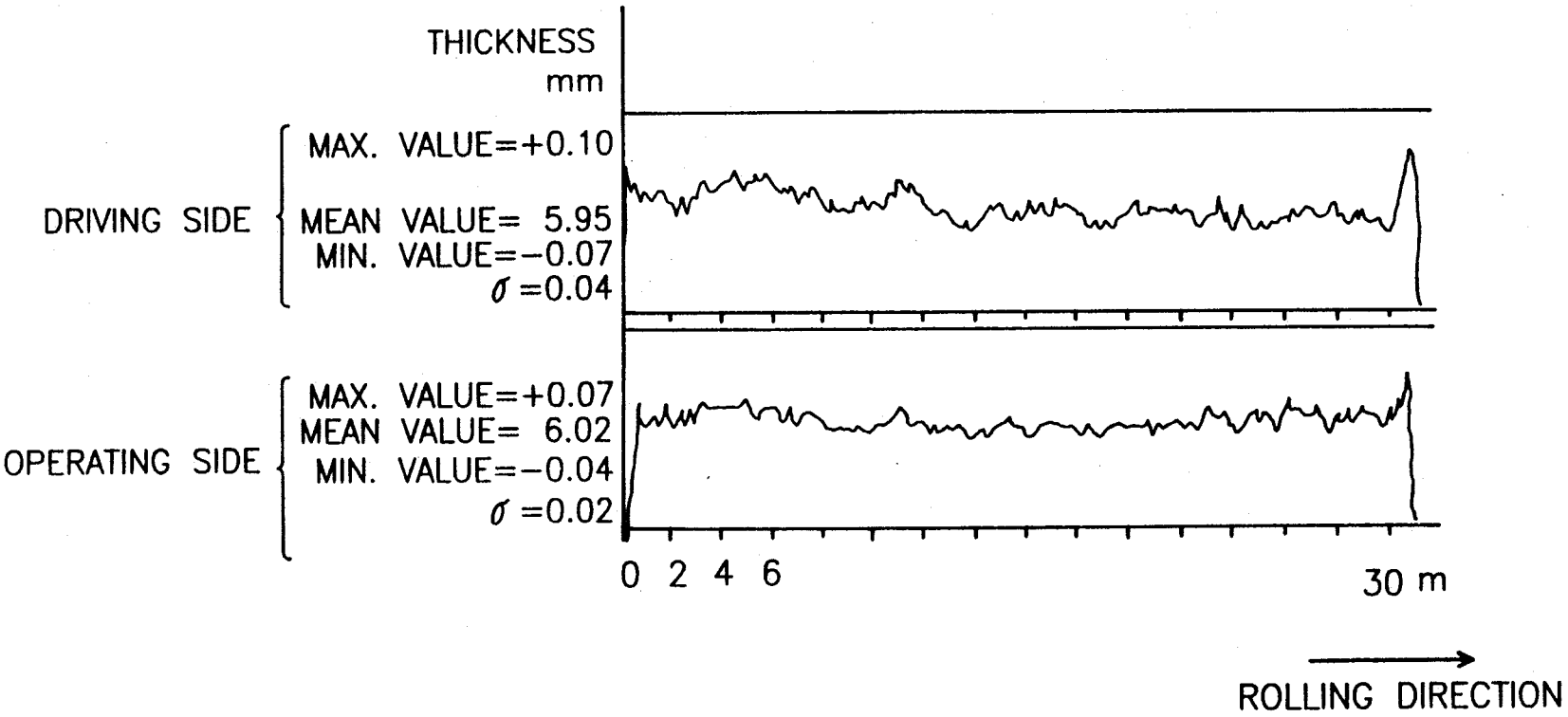
FIG. 9 shows the same representations as in FIG. 8 when the method according to the present invention is utilized for compensating the roll eccentricities.
Figure 10:
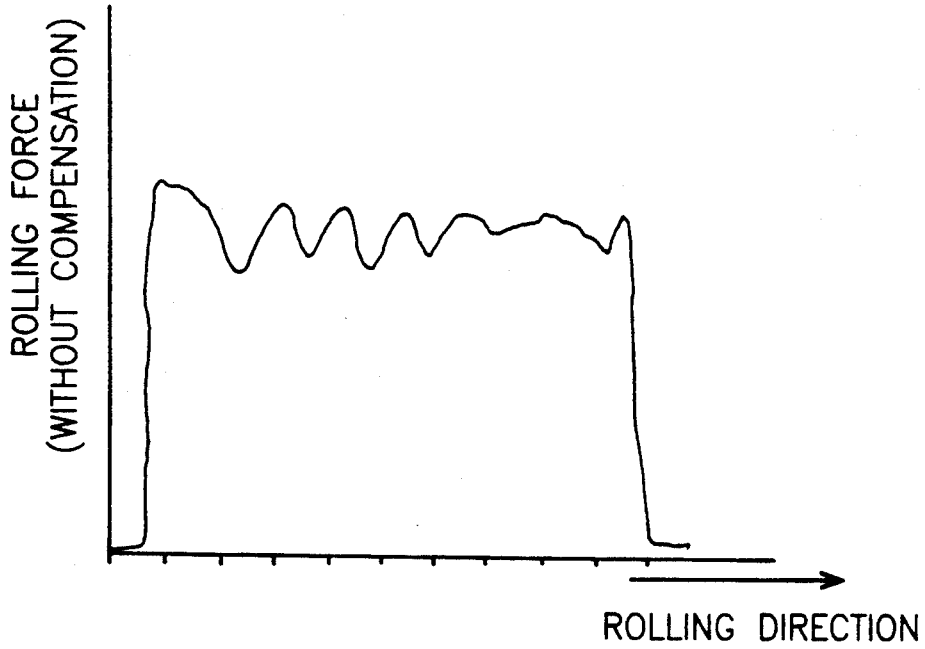
FIG. 10 shows a graphical representation of a rolling force variation when the method according to the present invention is not utilized for compensating the roll eccentricities.
Figure 11:
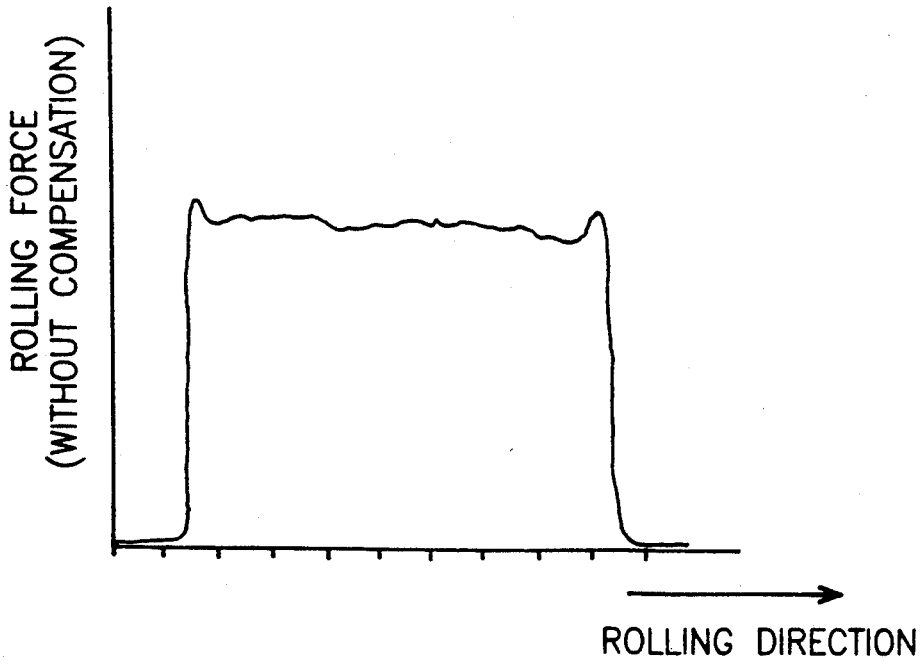
FIG. 11 shows the same representation as in FIG. 10 when the method according to the present invention is utilized for compensating the roll eccentricities.

Referring now to FIGS. 8 and 9, wherein FIG. 8 shows two graphical representations of the thickness variations of the two sides of a rolling plate without the roll eccentricities being compensated, and FIG. 9 shows the same representations as in FIG. 8 when the method according to the present invention is used. It is obviously evidenced by the figures that the thickness variations have been considerable reduced by the utilization of the method according to the present invention to the rolling mill.

The method is similar to the lookup table method. However, the off-line method utilized by the lookup table method for building up the eccentricity table is time-consuming and laborious. The method provided by the present invention, on the other hand, is automated and efficient. Instead of tedious eccentricity measuring, the present invention takes a different approach which utilizes a digital computer to calculate the eccentricity values. The result is more fast and accurate eccentricity compensations.

While the invention has been described by way of example and in terms of a preferred embodiment, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. In a rolling mill having a top work roll backed with a top backup roller and a bottom work roll backed with a bottom backup roller for rolling a plate, a method of correcting thickness variations of the plate when the plate is being rolled through a gap between the top work roll and the bottom work roll, said method comprising:

an off-line eccentricity identification method which is performed when there is no plate rolling through the mill and with the top work roll and the bottom work roll in tight contact, said off-line eccentricity identification method determining the eccentricity values of N first points which equally divide a circumference of the top backup roll and N second points which equally divide a circumference of the bottom backup roll, N being a pre-determined integer number; and an on-line eccentricity compensation method which is performed with a plate being rolled through a gap between the work rolls, said on-line eccentricity compensation method comprising:

a. determining eccentricity values of a point on the circumference of the top backup roll and a point on the circumference on the bottom backup roll which are in contact with the work rollers by interpolating known eccentricity values determined in said off-line eccentricity identification method;

b. determining an eccentricity compensation value in accordance with the eccentricity values determined in step a;

c. converting said eccentricity compensation value of step b into a controlling signal for controlling a position of at least one of the backup rolls relative to the other backup rolls to compensate eccentricities thereof; and d. deciding if rolling is completed, and if not, repeating steps a through d thereof until the decision of step d is positive, and terminating rolling, and wherein said off-line eccentricity identification method determines eccentricity values of said N first points and said N second points by performing 2N times of a measurement utilizing a relationship of:

$$E_x+E_y=(1/M)*F,$$

where;

$E_x$ is an eccentricity value of a point x at the circumference of the top backup roll in contact with the top work roll, $E_y$ is an eccentricity value of a point y at the circumference of the bottom backup roll in contact with the bottom work roll, M is the mill modulus, and F is the variation in the rolling force caused by the eccentricity;

the data from the 2N times of the measurement forming a matrix equation of $A'X=Y'$, where;

$A'$ is a 2N by 2N square matrix;

X is a 2N by 1 vector, and $Y'$ is a 2N by 1 vector, and eccentricity values of said N first points and said N second points being determined by solving the matrix equation for $X=A'^{-1}$.

2. A method according to claim 1, wherein the number N is 36.

* * * * *